United States Patent [19]

Burke

[11] Patent Number: 4,644,753

[45] Date of Patent: Feb. 24, 1987

[54] REFRIGERATOR

[75] Inventor: Edward J. Burke, Plano, Tex.

[73] Assignee: Marlow Industries, Inc., Dallas, Tex.

[21] Appl. No.: 783,969

[22] Filed: Oct. 4, 1985

[51] Int. Cl.[4] ..... F25B 21/02

[52] U.S. Cl. ..... 62/3; 62/291

[58] Field of Search ..... 62/3, 291

[56] References Cited

U.S. PATENT DOCUMENTS

| | | | |
|---|---|---|---|
| 2,932,953 | 4/1960 | Becket et al. | 62/3 |
| 3,177,671 | 4/1965 | Stambaugh | 62/3 |
| 3,195,315 | 7/1965 | Boehmer et al. | 62/3 |
| 3,200,600 | 8/1965 | Elfving | 62/3 |
| 3,209,547 | 10/1965 | Elfving | 62/3 |
| 3,232,063 | 2/1966 | Eichhorn et al. | 62/3 |
| 4,487,024 | 12/1984 | Fletcher et al. | 62/3 |
| 4,513,586 | 4/1985 | Jennings et al. | 62/291 X |

*Primary Examiner*—Lloyd L. King

[57] ABSTRACT

A noiseless refrigerator is provided for use in single room sleeping quarters. The refrigerator has a housing having a freezing compartment, a cooling compartment, a storage compartment and a vented compartment. The freezing compartment has a bottom having a plurality of recesses formed therein for removably receiving a plurality of ice cube trays and a back side affixed to an "L" shaped plate support member attached to the inside of a refrigerator wall. The "L" shaped plate freezer compartment support member is in thermal contact with a plurality of blocks of high thermal conductivity material passing through the refrigerator walls to the vented compartment. A plurality of thermoelectric heat pumps are mounted in the vented compartment and have their hot plates attached to a heat sink for ventilation. The cold plates of the plurality of heat pumps are affixed to the blocks of high thermal conductivity material to substantially reduce the temperature of the ice cube trays in the freezer compartment to freeze ice cubes.

4 Claims, 2 Drawing Figures

REFRIGERATOR

This invention relates to refrigerators and more particularly to a noiseless refrigerator.

In the past refrigerators utilized in hotel rooms and motel rooms have had the disadvantage of making noises when turning on, during operation and turning off. The noise has been so objectionable as to preclude their use in single room sleeping quarters. The noise is generated by moving parts including the compressor motor, and in some cases a fan and fan motor.

Accordingly it is an object of this invention to provide a substantially noiseless refrigerator for use even in single room sleeping quarters.

Another object of the invention is to provide a totally solid state refrigerator to yield high reliability and low maintenance. Yet another objective of the invention is to provide a noiseless refrigerator whose cost is not prohibitive of use in single room sleeping quarters.

Still another objective of the invention is to provide single room sleeping quarters occupants the luxury afforded occupants of multi-room sleeping quarters by the prior art refrigerators.

Briefly stated the invention comprises a refrigerator having a thermoelectric heat pump connected to an ice freezer compartment means. The thermoelectric heat pump cools the ice compartment means to freeze water in an ice cube tray placed in the compartment for producing ice cubes.

Figure 1:
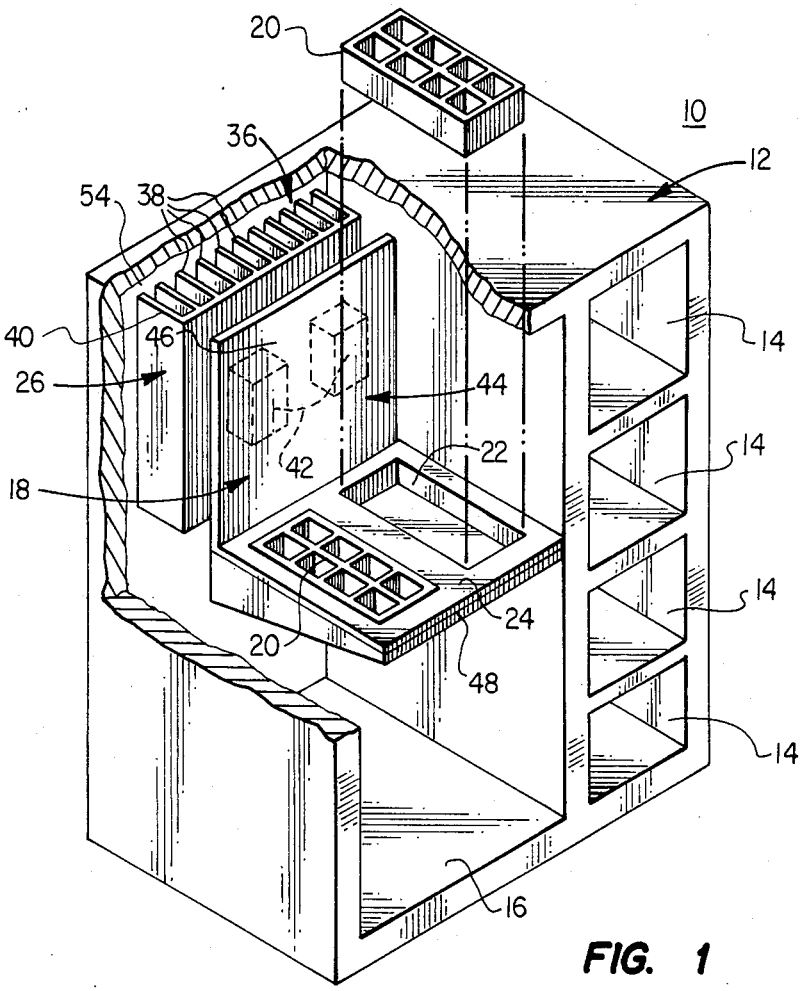
Figure 2:
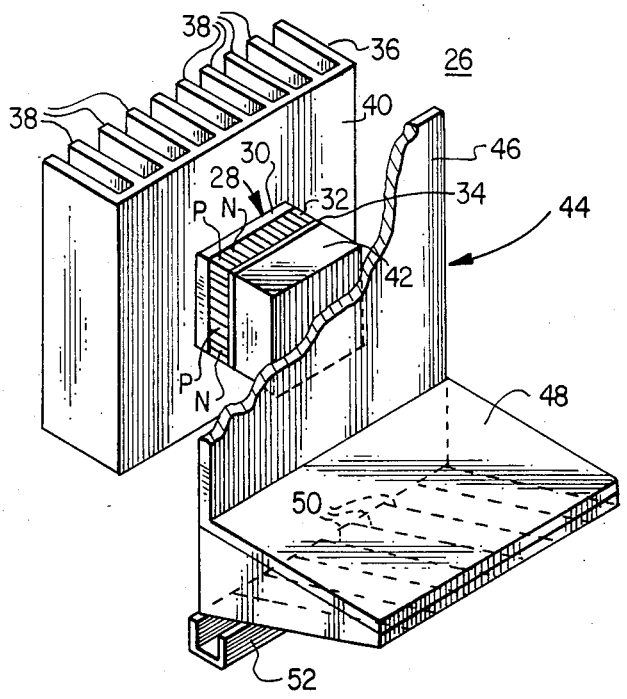

The novel features characteristic of the embodiment of the invention may best be understood by reference to the following detailed description when read in conjunction with the accompanying drawings, wherein:

FIG. 1 is an isometric view of the refrigerator constituting the subject matter of this invention; and FIG. 2 is a partial view of the refrigerator with a part broken away to more clearly show features of the thermoelectric heat pump mechanism.

Referring now to FIG. 1, the refrigerator 10 comprises an insulated box 12. The door of the box 12 has been removed to disclose a plurality of vertically arranged storage compartments 14, a cooler compartment 16 and a freezer compartment 18.

The storage compartments 14 are for holding bottled or canned beverages and beverage accessories. The cooler compartment is for storing food and beverages requiring refrigeration. Whilst, the freezer compartment is for freezing ice cubes in trays 20 of which one tray 20 is removed to disclose the recess areas 22 in the freezer compartment floor 24. The recessed areas 22 are for retaining the trays 22 in selected positions within the freezer compartment with respect to a thermoelectric heat pump means 26.

Referring now to FIG. 2 for a description of the thermoelectric heat pump means 26. The thermoelectric heat pump means 26 comprises at least one thermoelectric heat pump 28; two thermoelectric heat pumps 28 are preferred as indicated by the two thermal conductors 42 of FIG. 1. Those persons skilled in the art will appreciate that even more than two thermoelectric heat pumps may be used. The thermoelectric heat pump 28 is preferably a MI1069-03AC thermoelectric heat pump sold by Marlow Industries, Inc. of Dallas, Tex. Although two thermoelectric heat pumps are preferred they are identical in construction and therefore only one is described. The thermoelectric heat pump 28 (FIG. 2) comprises a hot plate 30, a thermopile 32, and a cold plate 34.

The hot plate 30 is affixed to a heat sink 36. It will be appreciated by those skilled in the art that the hot plates of a plurality of thermoelectric heat pumps are affixed to the heat sink 36. The heat sink 36 is made of a suitable material having a high thermal temperature coefficient and having a pluraity of spaced fins 38 affixed to a flat plate 40 for providing a substantial cooling surface area.

The thermopile 32 comprises an array of thermocouples. Each thermocouple consisting of P-type and N-type elements connected electrically is series with alternatively P-type and N-type elements electrically connected.

The thermopile 32 is sandwiched between the hot plate 30 and cold plate 34. Cold plate 34 and hot plate 30 are made of a material having a high temperature coefficient. A suitable material is, for example, alumina.

The cold plate 34 is affixed to a block of material (thermal conductor) 42 having a high temperaure coefficient. A suitable material is, for example, copper. The copper block 42 passes through the insulated, refrigerator box 12 (FIG. 1) to an "L" shaped freezer compartment support and freezing bracket 44 (FIG. 2). The "L" shaped bracket has a vertical plate 46 affixed to a horizontal plate 48.

The vertical plate 46 of the "L" shaped bracket 44 is affixed to the copper block 42 (or blocks 42 is more than one heat pump is used for cooling) and to the refrigerator box for support. A plurality of fins 50 are affixed to the horizontal plate 48.

The fins 50 are triangularly shaped fins having a substantially right angle with a slope of approximately 30 degrees from horizontal. A "U" shaped water transporting trough 52 is positioned to extend across the back of the refrigerator box and located at the base of the triangular shaped fins.

The refrigerator freezer compartment 18 (FIG. 1) is affixed to the "L" shaped bracket with its front and back side in thermal contact, respectively, with the vertical plate 46 and horizontal plate 48 thereof.

It will be appreciated by those skilled in the art that the refrigerator 10 (FIG. 1) may include a backside air vented housing 54 for the thermoelectric heat pump 28 and the heat sink 36.

In operation a source of power (not shown) is applied to the thermoelectric heat pump 28 (FIG. 1) with proper polarity to provide the hot plate 30 and cold plate 34. Heat from the hot plate 30 is dissipated by the heat sink 36. The cold plate 34 removes heat from the freezer compartment through the "L" shaped bracket 44 and the copper block or blocks 42. With the temperature of the freezer compartment, at least in the recessed areas 22 reduced substantially (below 0° C.), water in the ice cube trays is frozen into ice cubes for use in cooling the beverages, and the freezer compartment 18 cools substantially the cooler compartment 16.

During refrigeration the triangular fins 50 absorb heat from the refrigerator compartment and during defrost collects water forming on the freezer compartment 18 which runs down to the triangular shaped fins 50. The 30 degree angle has been found to provide a hypotenuse upon which the water will accumulate and run down to the trough 52. The trough 52 may then either be removed or emptied, or it may be connected to a capped drain conduit through the refrigerator box.

It will be appreciated by those persons skilled in the art that various changes, substitutions, and alternations can be made to the preferred embodiment without departing from the scope of the invention as defined by the appended claims.

I claim:

1. A refrigerator comprising:

(a) a housing having a vent compartment and an insulated box having a cooler compartment and a freezer compartment;

(b) a thermoelectric heat pump means mounted in the housing, the heat pump means including a finned heat sink of high temperature coefficient material mounted in the vent compartment, a hot plate attached to the heat sink, a thermopile having a hot side connected to the hot plate and a cold side, a block of high temperature coefficient material connected to the cold side and extending into the freezer compartment an L-shaped bracket of high temperature coefficient material having a vertical portion attached to the block and a horizontal portion, a freezer compartment of high temperature coefficient material having a bottom attached to the L-shaped horizontal portion, said bottom portion portion having walls forming an ice cube tray receiving recess whereby the continuous structure of high temperature coefficient material exists between the thermopile and ice cube tray receiving recess to produce a sub freezing temperature in the recess; and (c) an ice cube tray having a shape corresponding to that of the ice cube tray receiving recess whereby five sides of the ice cube tray are in freezing engagement with the bottom recess forming walls for freezing ice cubes.

2. A refrigerator comprising:

(a) a housing having a vent compartment and an insulated box having a cooler compartment and a freezer compartment;

(b) a thermoelectric heat pump means mounted in the housing, the heat pump means including a finned heat sink of high temperature coefficient material mounted in the vent compartment, a hot plate attached to the heat sink, a thermopile having a hot side connected to the hot plate and a cold side, a block of high temperature coefficient material connected to the cold side and extending into the freezer compartment a compartment of high temperature coefficient material having a vertical portion attached to the block and a horizontal bottom portion, said bottom portion having walls forming an ice cube tray receiving recess whereby the continuous structure of high temperature coefficient material exists between the thermopile and ice cube tray receiving recess to produce a sub freezing temperature therein;

(c) an ice cube tray having a shape corresponding to that of the ice cube tray receiving recess whereby five sides of the ice cube tray are in freezing engagement with the bottom recess forming walls for freezing ice cubes;

(d) a plurality of triangularly shaped fins depending downwardly and rearwardly of the freezer compartment at a preselected slope for absorbing heat from the cooling compartment during freezing and draining rearwardly ice water during defrost for collection; and (e) a trough positioned as to the fins for collecting the ice water whereby when either the insulated box is open or the cooling efficiency of the thermoelectric heat pump decreases the ice accumulated on the freezer compartment begins to melt and slide down the fins for collection in the water trough for removal or evaporation.

3. A refrigerator according to claim 2 wherein the preselected angle formed by the second and third side of the fin is about 30 degrees.

4. A refrigerator according to claim 2 wherein the freezer compartment is affixed to the "L" shaped bracket.

* * * * *